US007731513B1

(12) United States Patent
Lin

(10) Patent No.: US 7,731,513 B1
(45) Date of Patent: Jun. 8, 2010

(54) CONDUCTIVE ASSEMBLY AND ELECTRICAL CONNECTOR HAVING THE SAME

(75) Inventor: Chin-Chi Lin, Keelung (TW)

(73) Assignee: Lotes Co., Ltd, Keelung (TW)

( * ) Notice: Subject to any disclaimer, the term of this patent is extended or adjusted under 35 U.S.C. 154(b) by 0 days.

(21) Appl. No.: 12/420,500

(22) Filed: Apr. 8, 2009

(51) Int. Cl.
*H01R 3/08* (2006.01)

(52) U.S. Cl. ..... 439/179

(58) Field of Classification Search ..... 439/179
See application file for complete search history.

(56) References Cited

U.S. PATENT DOCUMENTS 5,779,492 A * 7/1998 Okuyama et al. ..... 439/179
7,147,478 B1 * 12/2006 Ju ..... 439/66

* cited by examiner

*Primary Examiner*—Ross N Gushi
(74) *Attorney, Agent, or Firm*—Ming Chow; Sinorica, LLC

(57) ABSTRACT

An electrical connector and a conductive assembly thereof are disclosed. The electrical connector includes an insulating body disposed with a plurality of receiving spaces, a first conductor correspondingly received in a receiving space and one end of the first conductor is hollowed out to form a receiving cavity, a liquid conductor stored in the receiving cavity, a second conductor, and a compressive elastic member. The second conductor having a main body that part thereof exposes outside of the receiving cavity, a guiding connection part extended from one end of the main body and located in the receiving cavity, and a stopper disposed between the main body and the guiding connection part. The compressive elastic member is arranged between the stopper and the bottom of the receiving cavity while the maximum compression distance of the compressive elastic member is larger than the distance between the rear end of the guiding connection part and the liquid conductor. Compared with the prior art, the conductive assembly and the electrical connector with the conductive assembly provide stable electrical connection.

18 Claims, 7 Drawing Sheets

CONDUCTIVE ASSEMBLY AND ELECTRICAL CONNECTOR HAVING THE SAME

FIELD OF THE INVENTION

The present invention relates to a conductive assembly thereof and an electrical connector having the conductive assembly, especially to a conductive assembly with stable electrical connection and the electrical connector having such conductive assembly.

DESCRIPTION OF RELATED ART

Refer to FIG. 1, a common electrical connector available consists of a first insulating body 11, a second insulating body 12, a first conductive member 21, a second conductive member 22, a liquid conductor 3 and an elastic member 4. A close receiving space 111 is formed by the first insulating body 11 and the second insulating body 12 for loading the first conductive member 21, the second conductive member 22, the liquid conductor 3 and the elastic member 4. The close receiving space 111 is nearly filled with the liquid conductor 3 that electrically connects the first conductive member 21 with the second conductive member 22.

The liquid conductor 3 is loaded in the close receiving space 111 formed by the first insulating body 11 and the second insulating body 12 while both the first conductive member 21 and the second conductive member 22 are connected with each other and are inserted into the close receiving space 111.

While assembling the electrical connector mentioned above, once the liquid conductor 3 is filled into the close receiving space 111 in advance, the close receiving space 111 is opened for insertion of the first conductive member 21 and the second conductive member 22. This causes leakage of the liquid conductor 3. If the first conductive member 21 and the second conductive member 22 are assembled into the second insulating body 12 firstly and the then the liquid conductor 3 is loaded into the close receiving space 111, there may be some gaps between the second conductive member 22 and the second insulating body 12. This also leads to leakage of the liquid conductor 3. Thus it's quite difficult to keep the liquid conductor 3 in a closed state no matter which assembling way is used.

The electrical connector mentioned above has following shortages:

1. After receiving a force from an external electric component, the liquid conductor 3 is easy to leak out from the contact area between the close receiving space 111 and the first conductive member 21 as well as the second conductive member 22. This leads to a short circuit and further affects stability of the electrical connection.

2. It is not easy to ensure that the liquid conductor 3 is in the closed state and the assembling processes are more difficult.

3. The close receiving space 111 needs to be almost completely filled with the liquid conductor 3 so as to have better electrical connection of the first conductive member 21 and the second conductive member 22. The liquid conductor 3 is wasted and the cost is also increased.

Thus there is a need to invent a new conductive component and an electrical connector having the new conductive component for overcoming the above shortcomings.

SUMMARY OF THE INVENTION

Therefore it is a primary object of the present invention to provide a conductive assembly with stable electrical connection and an electrical connector having the conductive assembly.

In order to achieve above object, the present invention provides a conductive assembly includes a first conductor in which one end thereof is hollowed out to form a receiving cavity, a liquid conductor stored in the receiving cavity, a second conductor, and a compressive elastic member. The second conductor having a main body and part of the main part exposes outside of the receiving cavity. A guiding connection part extends from one end of the main body, locates in the receiving cavity and electrically connects with the liquid conductor. A stopper is disposed between the main body and the guiding connection part and is located in the receiving cavity. The compressive elastic member is arranged between the stopper and the bottom of the receiving cavity and the maximum compression distance of the compressive elastic member is larger than the distance between the rear end of the guiding connection part and the liquid conductor.

Compared with the prior art, the liquid conductor of the conductive assembly is stored in the receiving cavity formed by the first conductor itself and is difficult to leak. Thus the electrical connection is not affected by the leakage and the assembling is getting simpler. The maximum compression distance of the compressive elastic member is larger than the distance between the rear end of the guiding connection part and the liquid conductor. There is no need to completely fill the receiving cavity with the liquid conductor to achieve electrical connection of the first conductor and the second conductor. The material used is reduced and the cost is down. Moreover, the stopper disposed between the main body and the guiding connection part is used to reduce abrasion between the first conductor and the receiving cavity during compression and deformation processes and increase stability of electrical connection.

In order to achieve above object, the present invention provides an electrical connector having the above conductive assembly that electrically connects an external electric component to a circuit board includes an insulating body disposed with a plurality of receiving spaces, at least one first conductor, at least one liquid conductor, at least one second conductor, and at least one compressive elastic member. Each first conductor is correspondingly received in each receiving space while one end of the first conductor is hollowed out to form a receiving cavity. Each liquid conductor is stored in reach receiving cavity. The second conductor includes a main body in which part thereof exposes outside the receiving cavity. A guiding connection part extends from one end of the main body, located in the receiving cavity and electrically connected with the liquid conductor. And a stopper is disposed between the main body and the guiding connection part while the stopper is located in the receiving space. The compressive elastic member is arranged between the stopper and the bottom of the receiving cavity while maximum compression distance of the compressive elastic member is larger than the distance between a rear end of the guiding connection part and the liquid conductor.

Compared with the prior art, the liquid conductor of the electrical connector is stored in the receiving cavity formed by the first conductor itself and is difficult to leak. Thus the electrical connection is not affected by the leakage and the assembling is getting simpler. The maximum compression distance of the compressive elastic member is larger than the distance between the rear end of the guiding connection part and the liquid conductor. There is no need to completely fill the receiving cavity with the liquid conductor to achieve electrical connection of the first conductor and the second conductor. The material used is reduced and the cost is down. Moreover, the stopper disposed between the main body and the guiding connection part is used to reduce abrasion between the first conductor and the receiving cavity during compression and deformation process and increases stability of electrical connection.

DETAILED DESCRIPTION OF THE PREFERRED EMBODIMENT

The structure and the technical means adopted by the present invention to achieve the above and other objects can be best understood by referring to the following detailed description of the preferred embodiments and the accompanying drawings.

Figure 1:
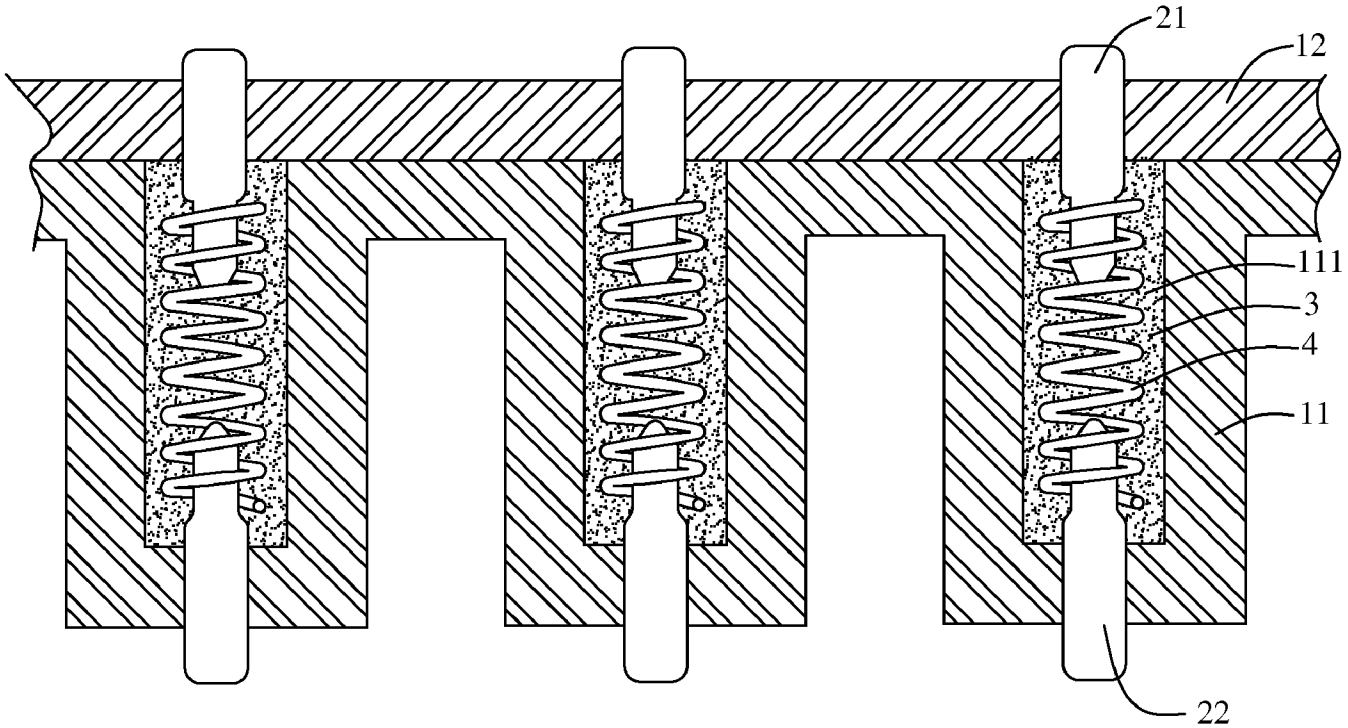
FIG.1 (PRIOR ART)
FIG. 1 is a cross sectional view of an electrical connector of a prior art.
Figure 2:
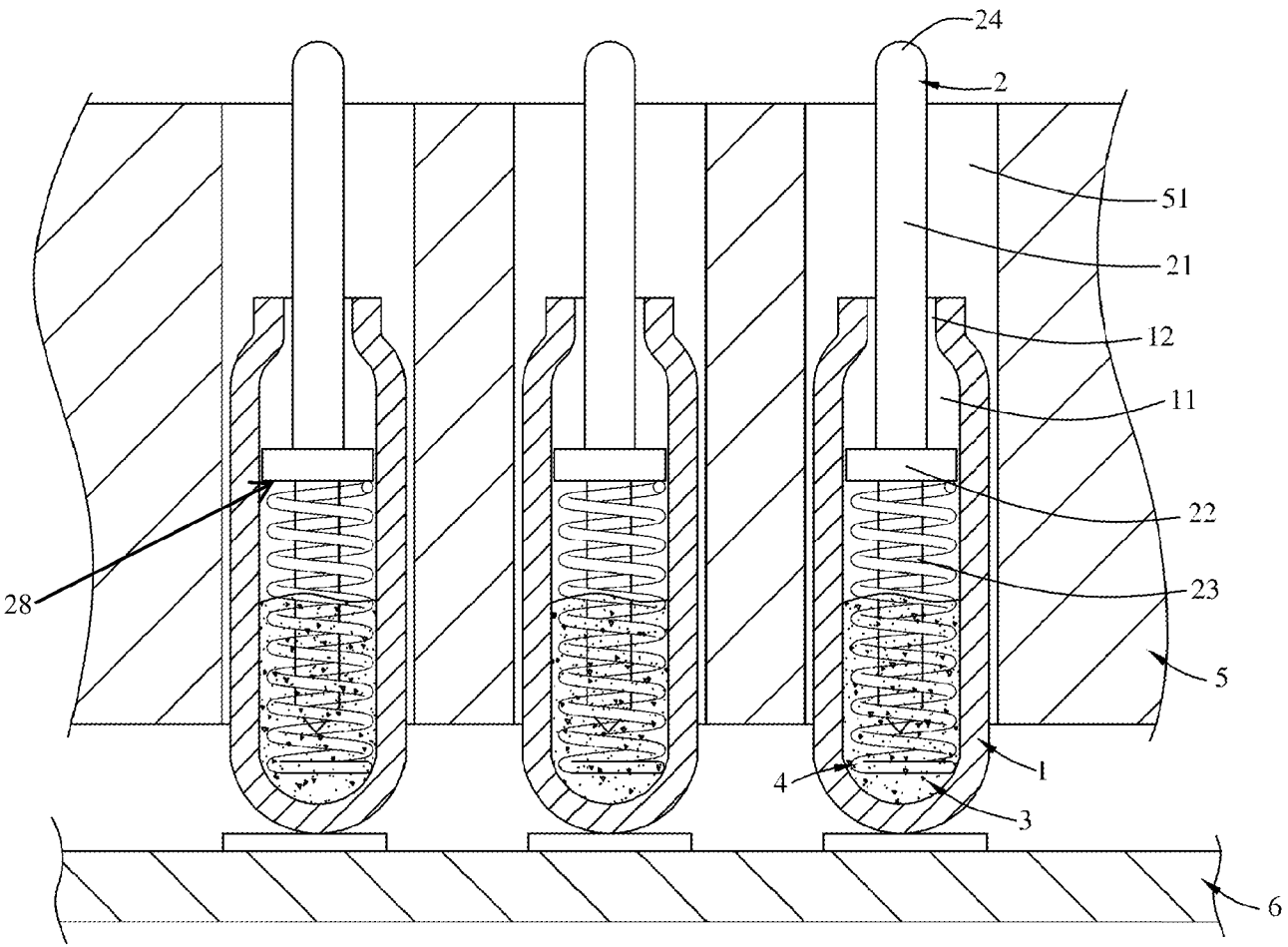
FIG. 2 is a cross sectional view of an embodiment of a conductive assembly and an electrical connector therewith according to the present invention.
Figure 3:
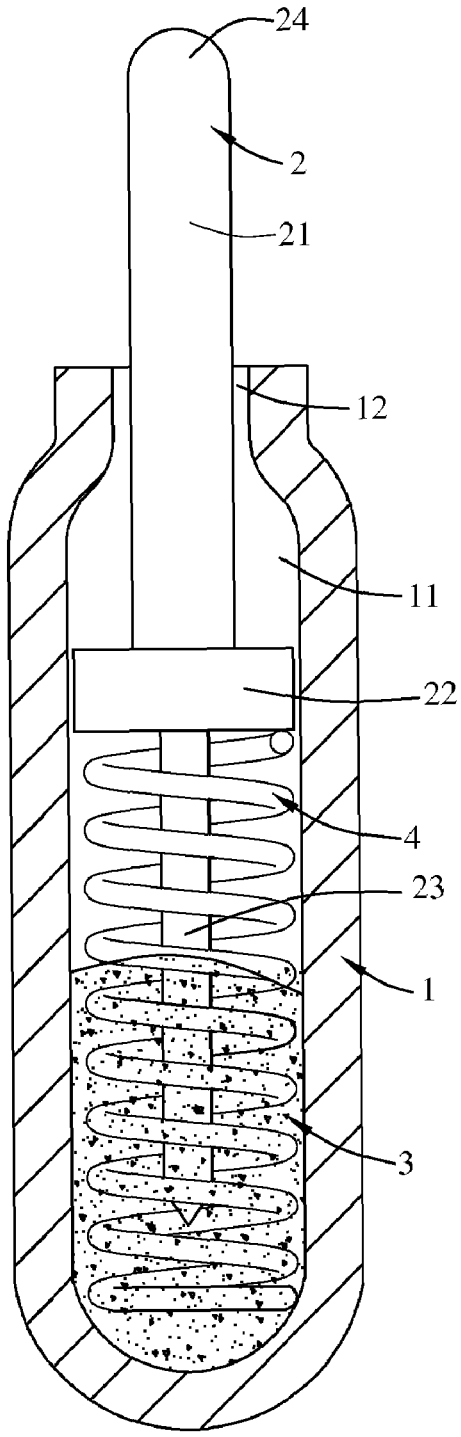
FIG. 3 is a cross sectional view of the conductive assembly in FIG. 2.
Figure 4:
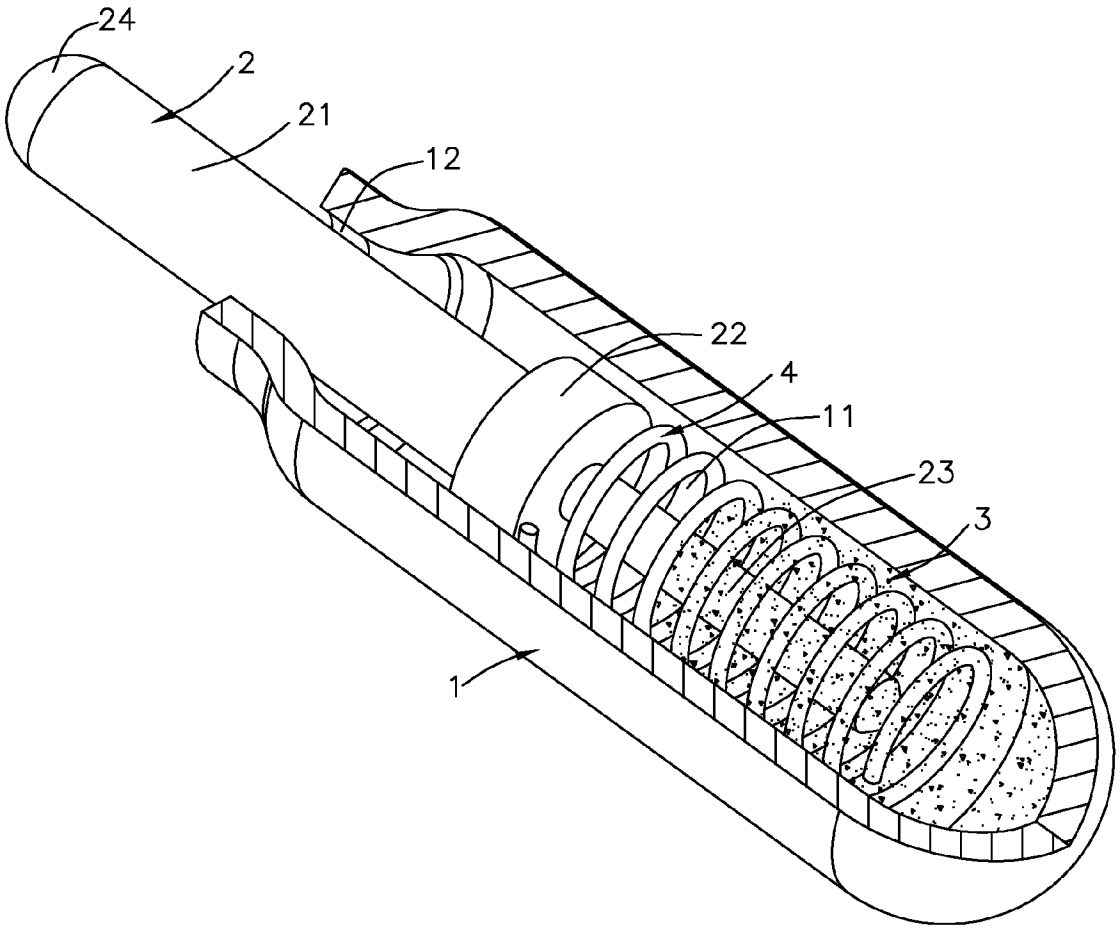
FIG. 4 is a perspective view of the conductive assembly in FIG. 2.

Referring from FIG. 2 to FIG. 4, an embodiment of an electrical connector according to the present invention includes an insulating body 5 and a plurality of conductive assemblies received in the insulating body 5.

The insulating body 5 is disposed with a plurality of receiving spaces 51 and each conductive assembly is correspondingly mounted in each receiving space 51.

Each conductive assembly consists essentially of a first conductor 1, a second conductor 2 in which part thereof is loaded in the first conductor 1, liquid conductor 3 stored in the first conductor 1 and a spring 4 located between the first conductor 1 and the second conductor 2.

The first conductor 1 is made of metal and each first conductor 1 is correspondingly received in one of the receiving spaces 51. The first conductor 1 is hollowed out to form a receiving cavity 11 in which the bottom end thereof exposes outside of the receiving space 51 while the other end thereof forms a contracted opening 12.

The liquid conductor 3 is stored in the receiving cavity 11 and the opening 12 is contracted so as to prevent leakage of the liquid conductor 3. The liquid conductor 3 can be mercury (Hg). In consideration of environmental protection, the liquid conductor 3 can be other liquid metal such as gallium-based alloy.

The second conductor 2 is inserted into the receiving cavity 11 through the opening 12 and part of the second conductor 2 is received in the receiving cavity 11.

The second conductor 2 has a main body 21. In this embodiment, the main body 21 extends into the receiving cavity 11 and passes through the receiving space 51.

A guiding connection part 23 extends from one end of the main body 21 and enters into the liquid conductor 3 so as to electrically connect with the liquid conductor 3. For saving materials and reducing cost, there is no need to completely fill the receiving cavity 11 with the liquid conductor 3.

The liquid conductor 3 is only filled into a certain height that the guiding connection part 23 contacts with the liquid conductor 3. Or the distance between the guiding connection part 23 and surface of the liquid conductor 3 is zero, the guiding connection part 23 and the liquid conductor 3 can also electrically connect with each other.

In other embodiments, before the spring 4 being compressed and deformed, the guiding connection part 23 is not necessarily soaked in the liquid conductor 3 once the maximum compression distance of the spring 4 is larger than the distance between the rear end 28 of the guiding connection part 23 and the liquid conductor 3. After the spring 4 being compressed by the second conductor 2 and deformed, the guiding connection part 23 electrically connects with the liquid conductor 3.

In consideration of surface tension of the liquid conductor 3, the bottom end of the guiding connection part 23 is designed into a conical shape so that the guiding connection part 23 is easily breaking the surface tension of the liquid conductor 3 and the electrical connection therebetween is getting better.

In other embodiments, the guiding connection part 23 can also be designed into other pyramids with a sharp end. Or the whole guiding connection part 23 itself is a pyramid and the apex of the pyramid is close to the bottom of the receiving cavity 11. Such design of the guiding connection part 23 can achieve the same effects as the above embodiment.

A contact part 24 extends from the other end of the main body 21 so as to electrically connect with an external electric component (not shown).

A stopper 22 is disposed between the main body 21 and the guiding connection part 23 and located inside the receiving cavity 11. The guiding connection part connects the stopper with its rear end 28. The width of the stopper 22 is larger than the width of the opening 12. In this embodiment, the stopper 22 is an insulator. For example, the stopper 22 is a rubber washer disposed around the main body 21 so as to reduce abrasion between the second conductor 2 and an inner wall of the receiving cavity 11 for improving stability of electrical connection.

The spring 4 is hollow, located between the bottom of the receiving cavity 11 and the stopper 22, disposed around the guiding connection part 23 and received in the receiving cavity 11 along the extension direction of the second conductor 2. The guiding connection part 23 penetrates the spring 4. One end of the spring 4 leans against the stopper 22 while the other end thereof is against the bottom of the receiving cavity 11. After an external electric component (not shown) acting on the spring 4, the spring 4 is elastically compressed along its extension direction. The maximum length of the spring can be compressed is defined as the previously mentioned "maximum compression distance".

In other embodiments, the spring 4 can be replaced by other compressive elastic members such as clips. The guiding connection part 23 penetrates the compressive elastic member.

While assembling the above electrical connector, firstly the liquid conductor 3 is filled into the receiving cavity 11. Then the second conductor 2 is inserted into the receiving cavity 11 and is electrically connected with the liquid conductor 3. Next the opening 12 of the receiving cavity 11 is contracted so as to prevent the liquid conductor 3 from leaking out of the receiving cavity 11. At last, the assembled conductive assembly is mounted in the receiving spaces 51 to form the electrical connector. The rear end of the guiding connection part 23 is designed into a conical form so as to reduce insertion force of the second conductor 2 while entering the receiving cavity 11. Therefore, the assembling is getting easier.

In use, the outer surface on the bottom of the receiving cavity 11 is electrically connected with a circuit board 6 directly or is welded on the circuit board 6 by a solder (not shown).

Figure 5:
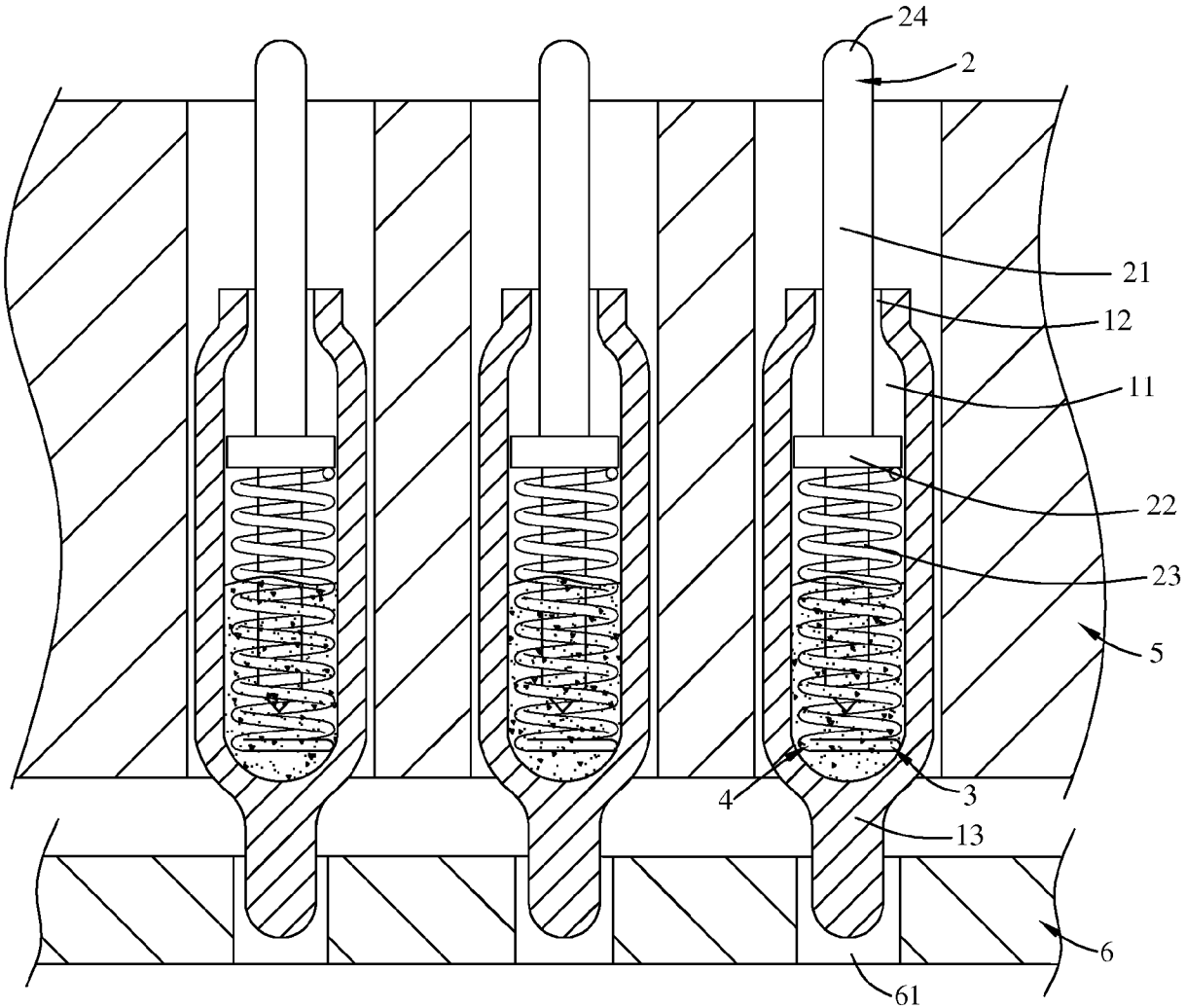
FIG. 5 is a cross sectional view of another embodiment of a conductive assembly and an electrical connector therewith according to the present invention.
Figure 6:
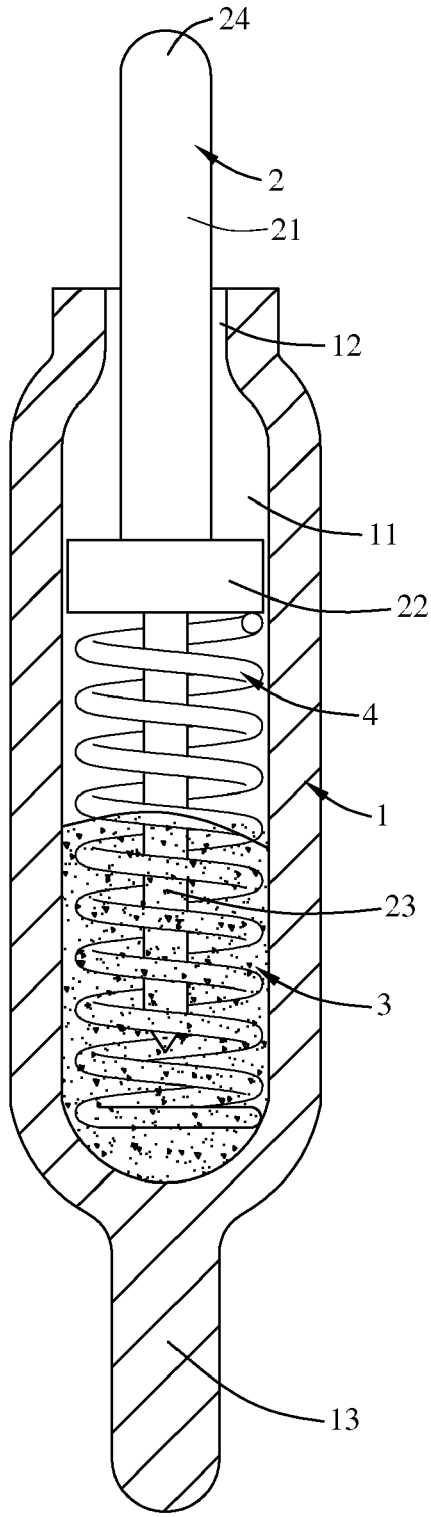
FIG. 6 is a cross sectional view of the conductive assembly in FIG. 5.

Referring from FIG. 5 to FIG. 6, another embodiment is revealed. The difference between this embodiment and the above one is in that: the outer surface on the bottom of the receiving cavity 11 formed by the first conductor 1 itself extends outward to form an inserting part 13 that is assembled with each corresponding insertion holes 61 disposed on the circuit board 6.

Figure 7:
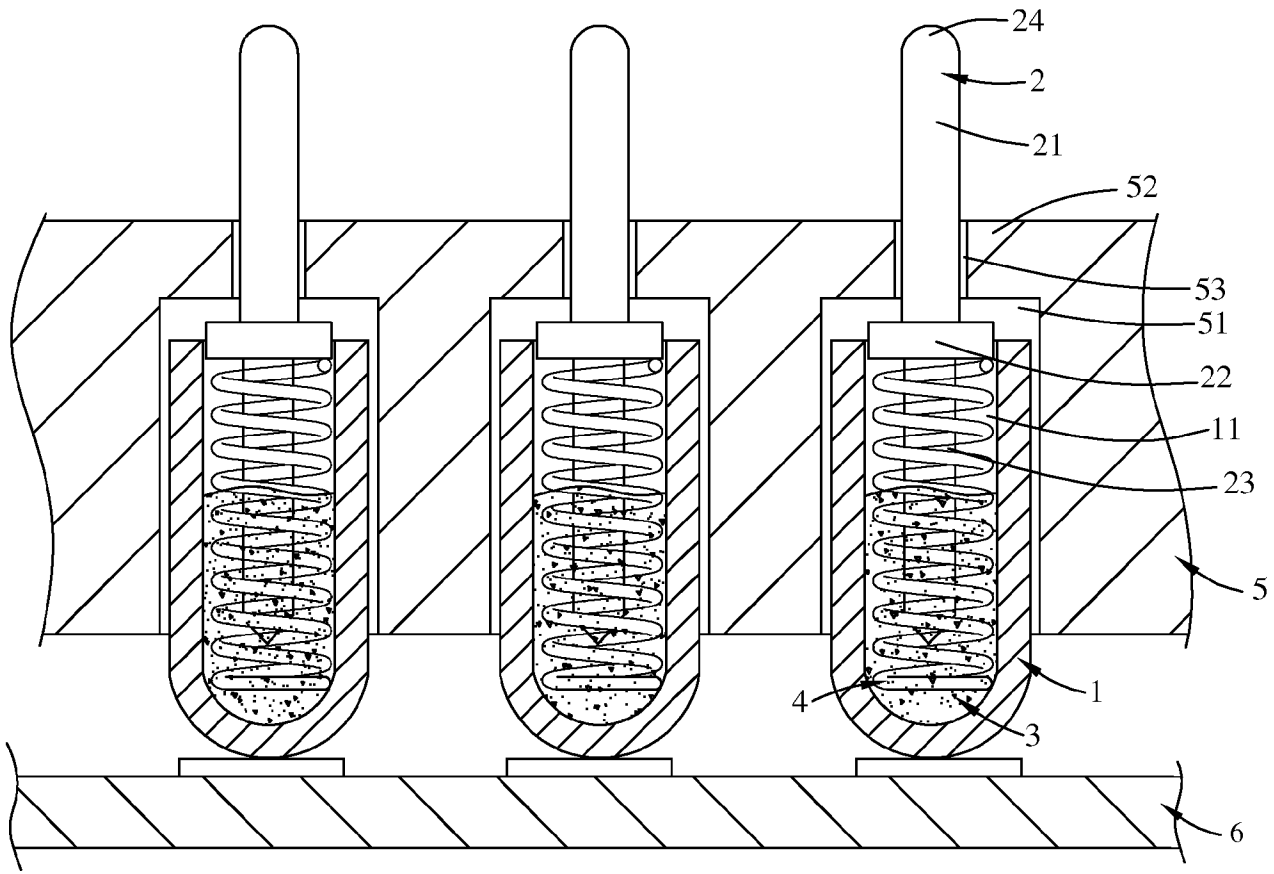
FIG. 7 is a cross sectional view of a further embodiment of a conductive assembly and an electrical connector therewith according to the present invention.

Referring to FIG. 7, a further embodiment is disclosed. The difference between this embodiment and the above two embodiments is in that the stopper 22 is received inside the receiving space 51. A stopping block 52 is arranged on each of two sides of an opening end of the receiving space 51 to form a contracted space 53 and the distance between the two stopping blocks 52 is smaller than the width of the stopper 22. The contracted space 53 is connected with the receiving space 51. Thus the stopper 22 moves slidingly between the receiving space 51 and the receiving cavity 11.

In summary, the conductive assembly and the electrical connector having the conductive assembly of the present invention achieve following effects:

1. The liquid conductor electrically connects with the first conductor and the second conductor respectively, the conductive assembly of the present invention reduces resistance dramatically and provides better electrical connection.

2. The electrical connection of the first conductor as well as of the second conductor is achieved without fully filling of the liquid conductor in the receiving cavity. Thus the amount of the liquid conductor used is reduced and the cost is down.

3. The liquid conductor in the conductive assembly is stored in the receiving cavity formed by the first conductor itself, so it is difficult to leak and the electrical connection will not be affected. Moreover, the insulating body will not be polluted by the leaking liquid conductor.

4. The assembling of the electrical connector is getting easier because the liquid conductor is stored in the receiving cavity formed by the first conductor itself.

5. The stopper that is an insulator reduces abrasion between the first conductor and the receiving cavity during compression and deformation process.

Additional advantages and modifications will readily occur to those skilled in the art. Therefore, the invention in its broader aspects is not limited to the specific details, and representative drawings shown and described herein. Accordingly, various modifications may be made without departing from the spirit or scope of the general inventive concept as defined by the appended claims and their equivalents.

What is claimed is:

1. A conductive assembly comprising:

a first conductor in which one end thereof is hollowed out to form a receiving cavity;

a liquid conductor stored in the receiving cavity;

a second conductor having a main body in which part thereof exposes outside of the receiving cavity, a guiding connection part extending from one end of the main body and located in the receiving cavity, and a stopper disposed between the main body and the guiding connection part and located in the receiving cavity, the stopper being formed of an insulator; and a compressive elastic member that is arranged between the stopper and the bottom of the receiving cavity while a maximum compression distance of the compressive elastic member is larger than the distance between a rear end of the guiding connection part and the liquid conductor.

2. The conductive assembly as claimed in claim 1, wherein distance between the rear end of the guiding connection part and surface of the liquid conductor is zero and the guiding connection part is electrically connected with the liquid conductor.

3. The conductive assembly as claimed in claim 1, wherein the guiding connection part extends into the liquid conductor.

4. The conductive assembly as claimed in claim 1, wherein the receiving cavity includes a contracted opening and width of the stopper is larger than width of the opening.

5. The conductive assembly as claimed in claim 1, wherein the stopper is a rubber washer disposed around the main body.

6. The conductive assembly as claimed in claim 1, wherein the guiding connection part is pyramidal.

7. The conductive assembly as claimed in claim 1, wherein the rear end of the guiding connection part is pyramidal.

8. The conductive assembly as claimed in claim 1, wherein the compressive elastic member is hollow so that the guiding connection part penetrates the compressive elastic member.

9. The conductive assembly as claimed in claim 8, wherein the compressive elastic member is a spring.

10. The conductive assembly as claimed in claim 1, wherein an inserting part is extended from the bottom of the receiving cavity and is used to connect with a circuit board.

11. The conductive assembly as claimed in claim 1, wherein the liquid conductor is liquid metal.

12. The conductive assembly as claimed in claim 11, wherein the liquid metal is mercury.

13. The conductive assembly as claimed in claim 11, wherein the liquid metal is gallium-based alloy.

14. An electrical connector comprising:

an insulating body disposed with a plurality of receiving spaces;

at least one first conductor and each first conductor correspondingly received in a receiving space and one end of the first conductor hollowed out to form a receiving cavity;

at least one liquid conductor and each liquid conductor stored in each receiving cavity;

at least one second conductor and the second conductor having a main body that part thereof exposes outside the receiving cavity, a guiding connection part extended from one end of the main body, located in the receiving cavity, and electrically connected with the liquid conductor;

a stopper disposed between the main body and the guiding connection part while the stopper is located in the receiving space, the stopper being formed of an insulator; and at least one compressive elastic member and the compressive elastic member arranged between the stopper and the bottom of the receiving cavity while a maximum compression distance of the compressive elastic member is larger than the distance between a rear end of the guiding connection part and the liquid conductor.

15. The electrical connector as claimed in claim 14, wherein the main body extends and passes through the receiving space.

16. The electrical connector as claimed in claim 14, wherein a stopping block is disposed on each of two sides of an opening of the receiving space and distance between the two stopping blocks is smaller than width of the stopper.

17. The electrical connector as claimed in claim 14, wherein the stopper is located in the receiving cavity.

18. The electrical connector as claimed in claim 14, wherein an inserting part is extended from the bottom of the receiving cavity and the inserting part is inserted into and connected with a circuit board.

* * * * *